US009139950B2

(12) United States Patent
Barrett et al.

(10) Patent No.: US 9,139,950 B2
(45) Date of Patent: Sep. 22, 2015

(54) DRYER LINT COLLECTION SYSTEM

(71) Applicants: Kenneth A. Barrett, Montgomery, AL (US); Roderic N. Uphaus, Troy, AL (US)

(72) Inventors: Kenneth A. Barrett, Montgomery, AL (US); Roderic N. Uphaus, Troy, AL (US)

(73) Assignee: Kenneth A. Barrett, Montgomery, AL (US)

( * ) Notice: Subject to any disclaimer, the term of this patent is extended or adjusted under 35 U.S.C. 154(b) by 0 days.

(21) Appl. No.: 14/529,698

(22) Filed: Oct. 31, 2014

(65) Prior Publication Data

US 2015/0121719 A1 May 7, 2015

Related U.S. Application Data

(60) Provisional application No. 61/899,918, filed on Nov. 5, 2013.

(51) Int. Cl.
*F26B 3/00* (2006.01)
*D06F 58/22* (2006.01)

(52) U.S. Cl.
CPC ..... *D06F 58/22* (2013.01)

(58) Field of Classification Search
CPC ..... D06F 58/22; F26B 25/007; D01H 11/005; B01D 45/12; B01D 46/0065
USPC ..... 34/480, 82, 237, 417
See application file for complete search history.

(56) References Cited

U.S. PATENT DOCUMENTS

| | | | | |
|---|---|---|---|---|
| 2,886,900 | A | 5/1959 | Flannery | |
| 3,748,746 | A * | 7/1973 | Robandt | 34/82 |
| 4,162,148 | A * | 7/1979 | Furstenberg | 96/425 |
| 4,314,409 | A | 2/1982 | Cartier et al. | |
| 4,462,170 | A | 7/1984 | Burkall et al. | |
| 4,700,492 | A | 10/1987 | Werner et al. | |
| 6,101,741 | A * | 8/2000 | Sears | 34/417 |

* cited by examiner

*Primary Examiner* — Kenneth Rinehart
*Assistant Examiner* — Bao D Nguyen
(74) *Attorney, Agent, or Firm* — Bush Intellectual Property Law; Kenneth M. Bush

(57) ABSTRACT

An automatic lint filter cleaning and lint collection system for a laundry dryer. The apparatus comprises a lint filter pivot chamber, a lint collection chamber, a lint filter housing pivotably mounted between the pivot chamber and collection chamber, a flange between the pivot chamber and collection chamber wherein the filter housing is biased into abutment with the flange, a lint collection container, an auger rotatably mounted within the collection chamber, and a drive assembly operably connected to the lint filter housing and auger. The drive assembly is operable to pivot the filter housing away from the flange and then to release the filter housing such that the filter housing forcibly returns into abutment with the flange and thereby causes the lint filter to release lint into the collection chamber. The drive assembly is operable to rotate the auger and thereby move lint from the collection chamber into the collection container.

19 Claims, 9 Drawing Sheets

DRYER LINT COLLECTION SYSTEM

CROSS-REFERENCE TO RELATED APPLICATION

This application claims priority to U.S. Provisional Patent Application No. 61/899,918 filed Nov. 5, 2013, the disclosure of which is incorporated herein by reference.

FIELD OF THE INVENTION

The present invention relates to lint collection systems for laundry dryers and, more particularly, to an automatic lint filter cleaning and lint collection system for laundry dryers.

BACKGROUND OF THE INVENTION

Laundry dryers typically have a rotatable drum that tumbles laundry as it is dried. A blower motor pulls heated air through the tumbling laundry to remove moisture from the laundry. As the air is drawn through the laundry, it picks up lint. The air/lint mixture is then pulled through a lint filter to remove the lint and then the filtered air can either be recycled back into the dryer air flow system or exhausted to the outside of the dryer. The lint filter must be cleaned frequently to prevent lint buildup and interference with proper air flow and dryer function. Lint filters are typically removed by hand and cleaned by a user, preferably after each drying cycle.

What is needed is an automatic lint filter cleaning and lint collection system to insure proper lint filter cleaning as well as to avoid the inconvenience to users of frequently cleaning lint filters.

SUMMARY OF THE INVENTION

The present invention comprises an automatic lint filter cleaning and lint collection apparatus and method for laundry dryers. The preferred lint filter cleaning and lint collection apparatus comprises an apparatus housing, a lint filter pivot chamber formed in an upper portion of the apparatus housing, a lint collection chamber formed in a lower portion of the apparatus housing below the pivot chamber, a lint filter housing pivotably mounted within the apparatus housing between the pivot chamber and the collection chamber, a lint filter secured within the filter housing, and a flange formed along an internal surface of the apparatus housing between the pivot chamber and the collection chamber, wherein the filter housing is biased into abutment with the flange. The preferred apparatus further comprises a lint collection container, a pipe connecting the lint collection chamber and the lint collection container, an auger rotatably mounted within the collection chamber, and a drive assembly operably connected to the lint filter housing and the auger. The drive assembly is operable to pivot the filter housing within the pivot chamber and away from the flange. The drive assembly is further operable to release the filter housing after the filter housing has been pivoted away from the flange such that the filter housing forcibly returns into abutment with the flange, causing the lint filter to release lint adhered thereto into the collection chamber. The drive assembly is further operable to rotate the auger and the auger is operable to move lint from the collection chamber, through the pipe, and into the collection container as the auger rotates. The lint in the collection container can be discarded when the collection container is full.

These and other features of the invention will become apparent from the following detailed description of the invention.

DETAILED DESCRIPTION OF THE INVENTION

Figure 1:
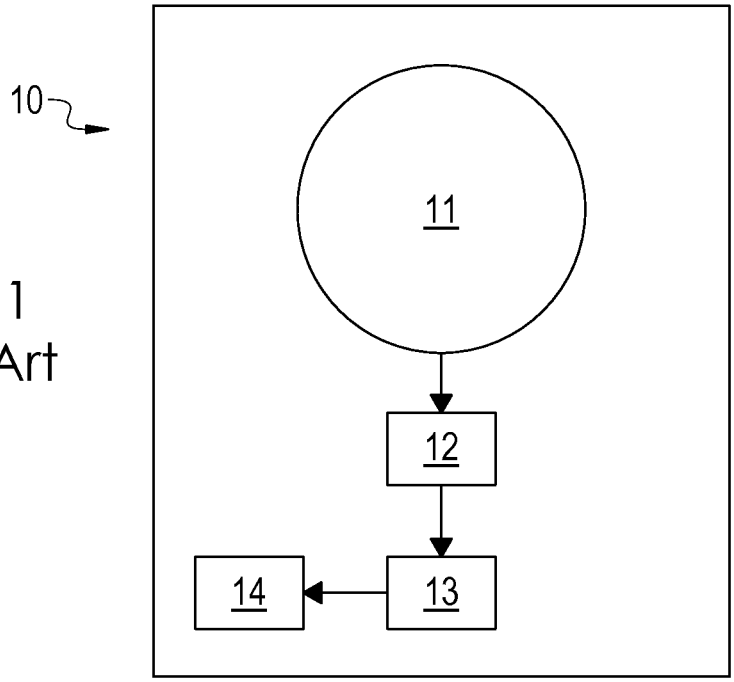
FIG. 1 Prior Art
FIG. 1 is a schematic view showing a typical prior art dryer system.

In FIG. 1, a typical prior art dryer system is schematically shown, wherein the dryer 10 includes a rotatable drum 11, an air conduit 12 having a hand removable lint filter (not shown) secured therein, a blower motor 13, and an air exhaust conduit 14. The blower motor 13 pulls heated air through the rotatable drum 11, through the air conduit 12 and lint filter, and then forces the air through the air exhaust conduit 14 to the outside of the dryer. The direction of air flow is indicated by the arrows.

Figure 2:
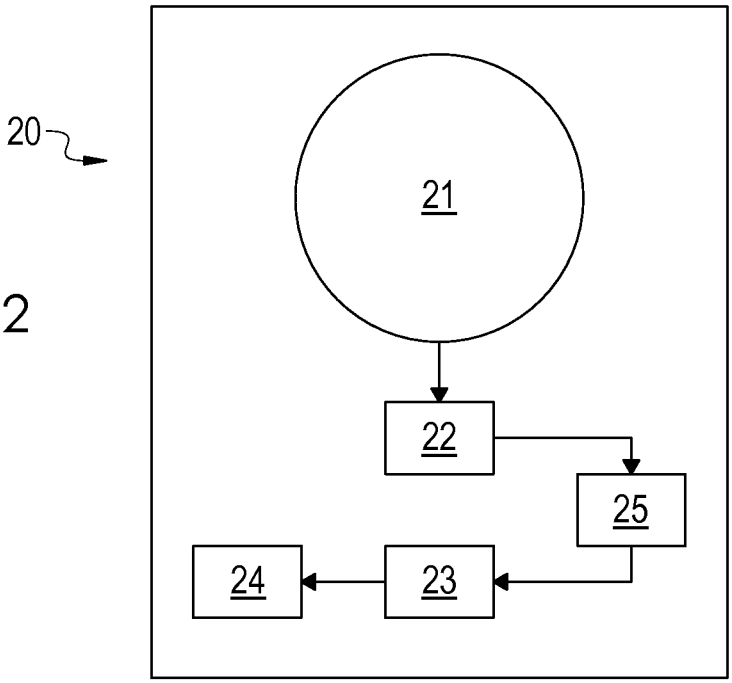
FIG. 2 is a schematic view showing the dryer system of the present invention.
Figure 3:
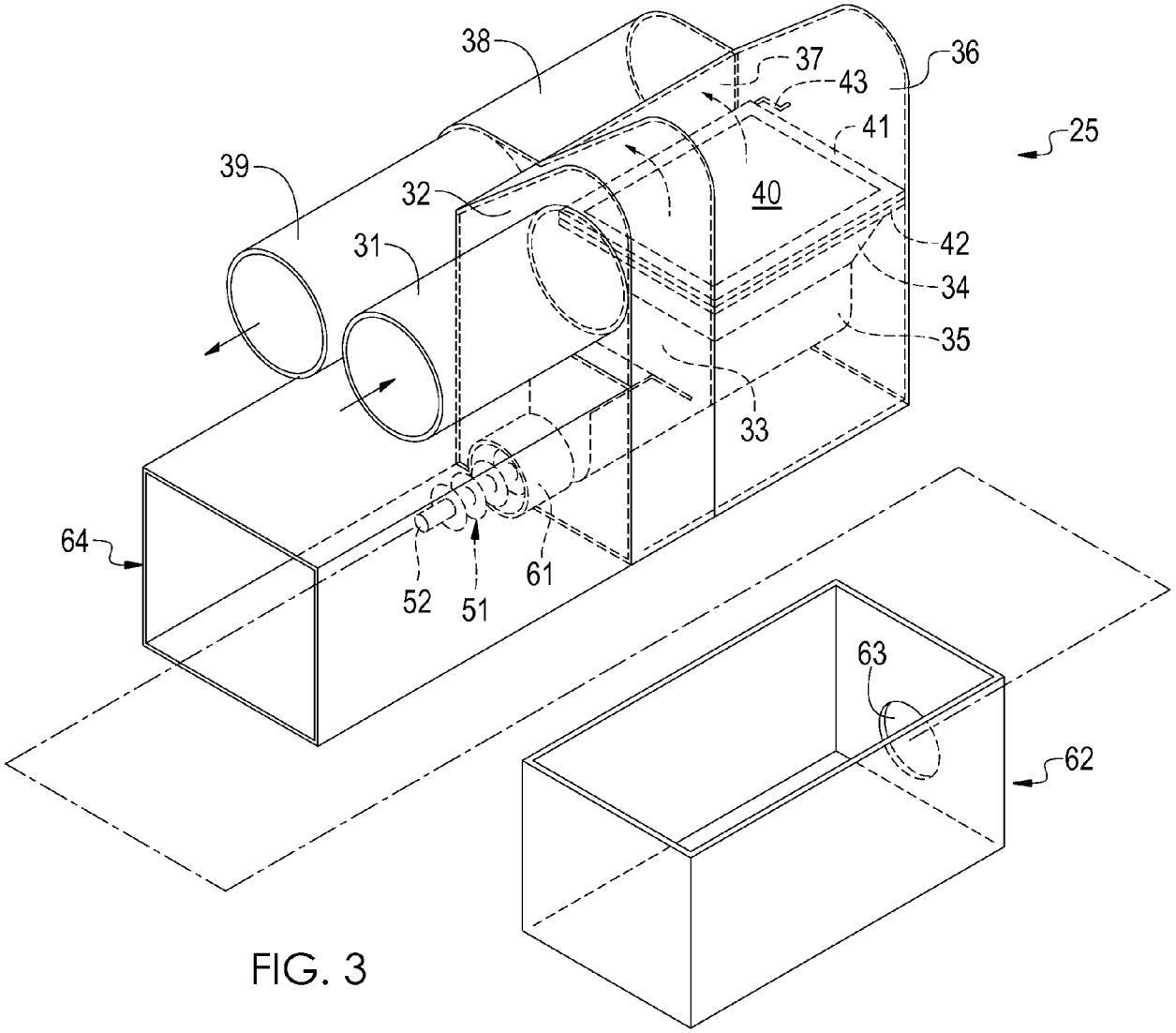
FIG. 3 is a partially exploded front perspective view showing the lint filter cleaning and collection system of the present invention.
Figure 4:
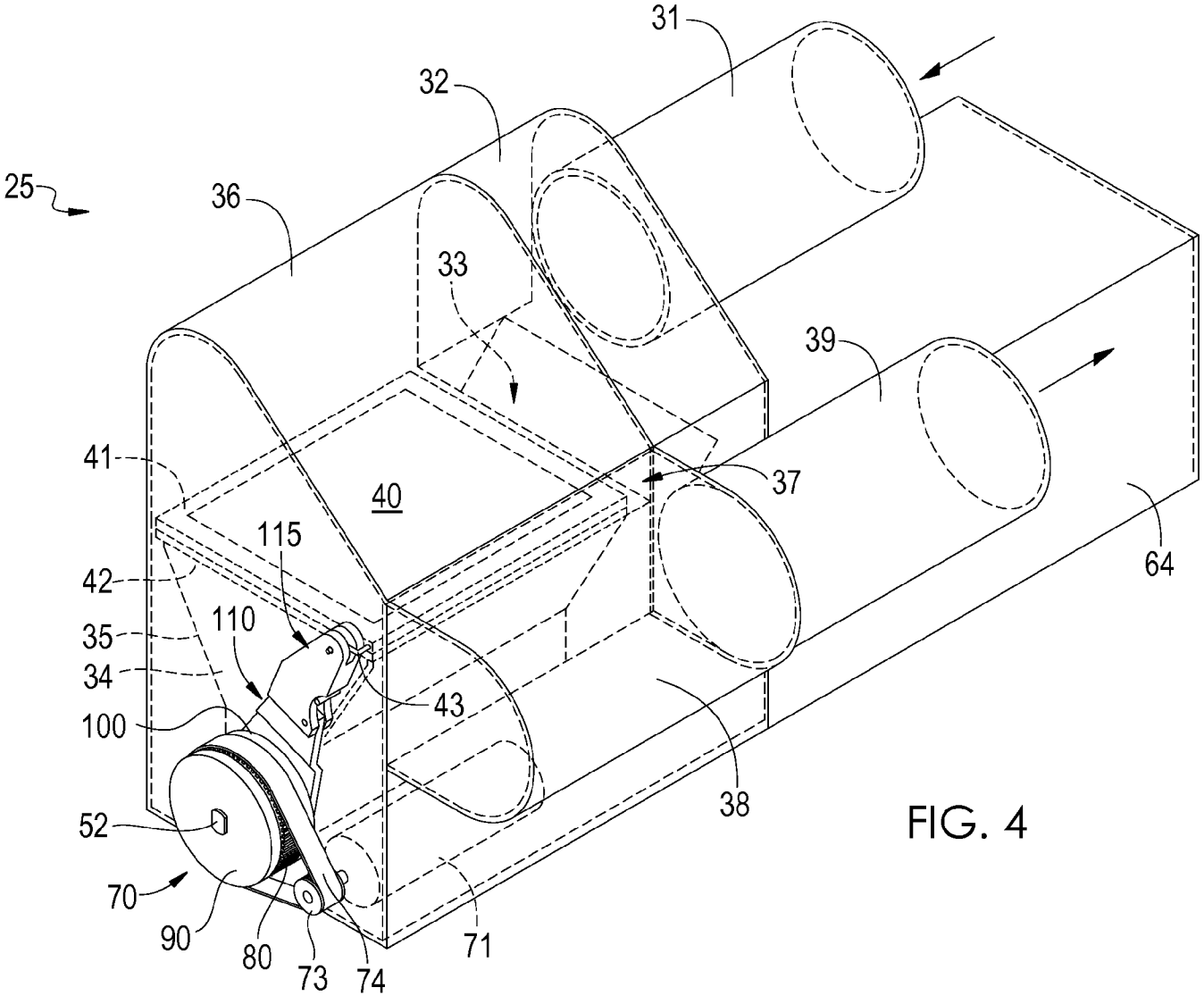
FIG. 4 is a rear perspective view showing the lint filter cleaning and collection system of the present invention.
Figure 5:
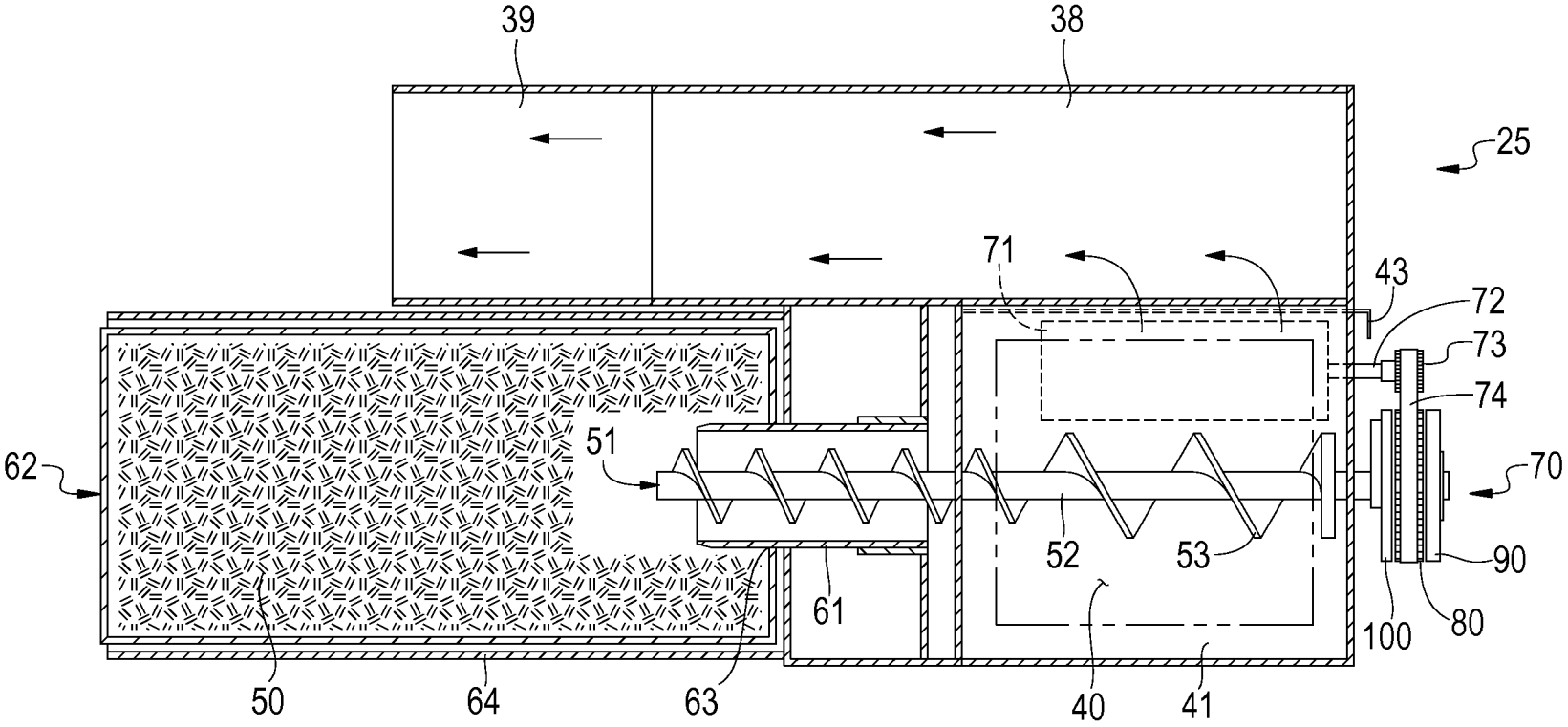
FIG. 5 is a top plan view, partially in section, showing the lint filter cleaning and collection system of the present invention.
Figure 6:
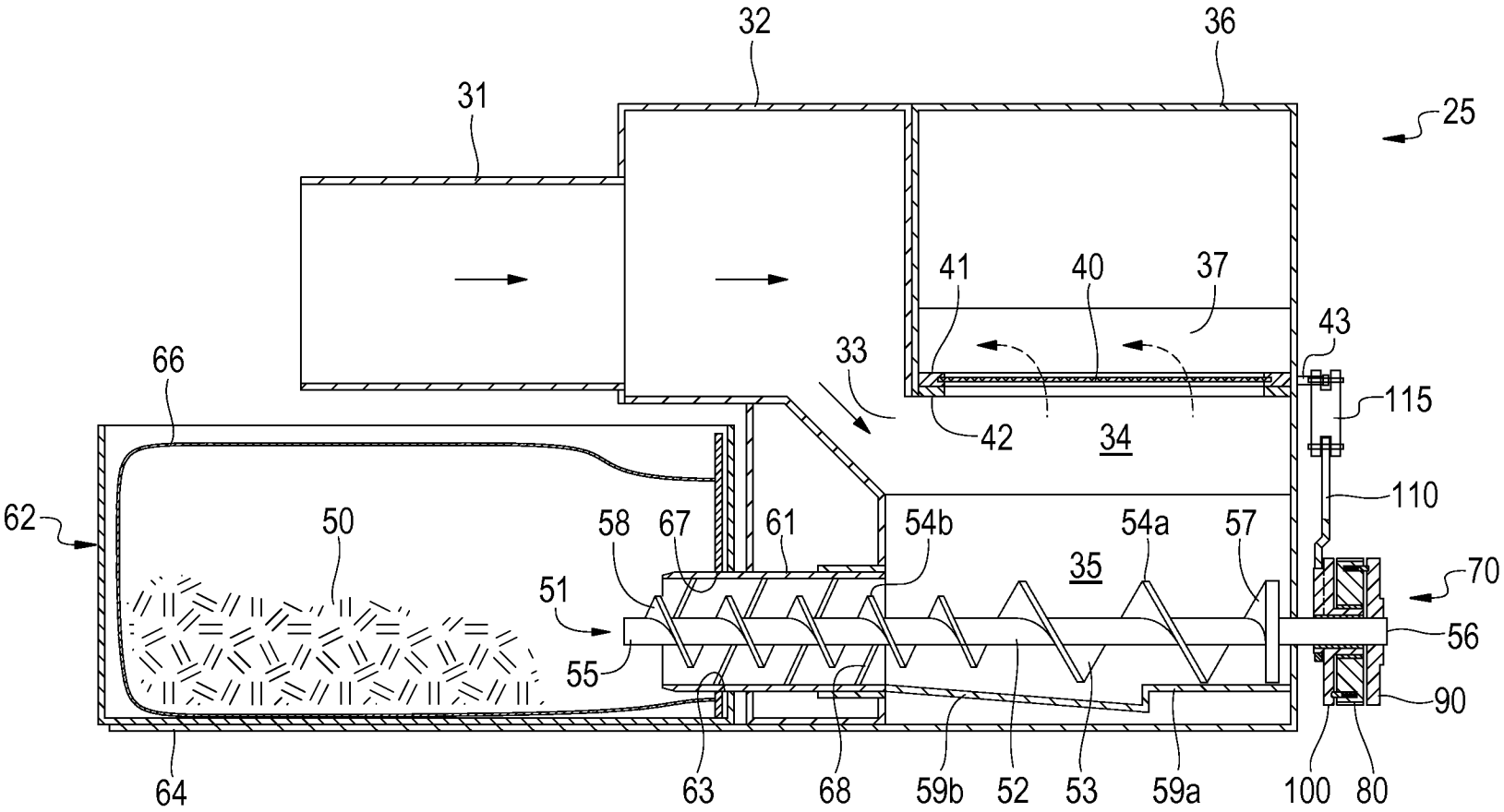
FIG. 6 is a side elevation view, partially in section, showing the lint filter cleaning and collection system of the present invention.
Figure 7:
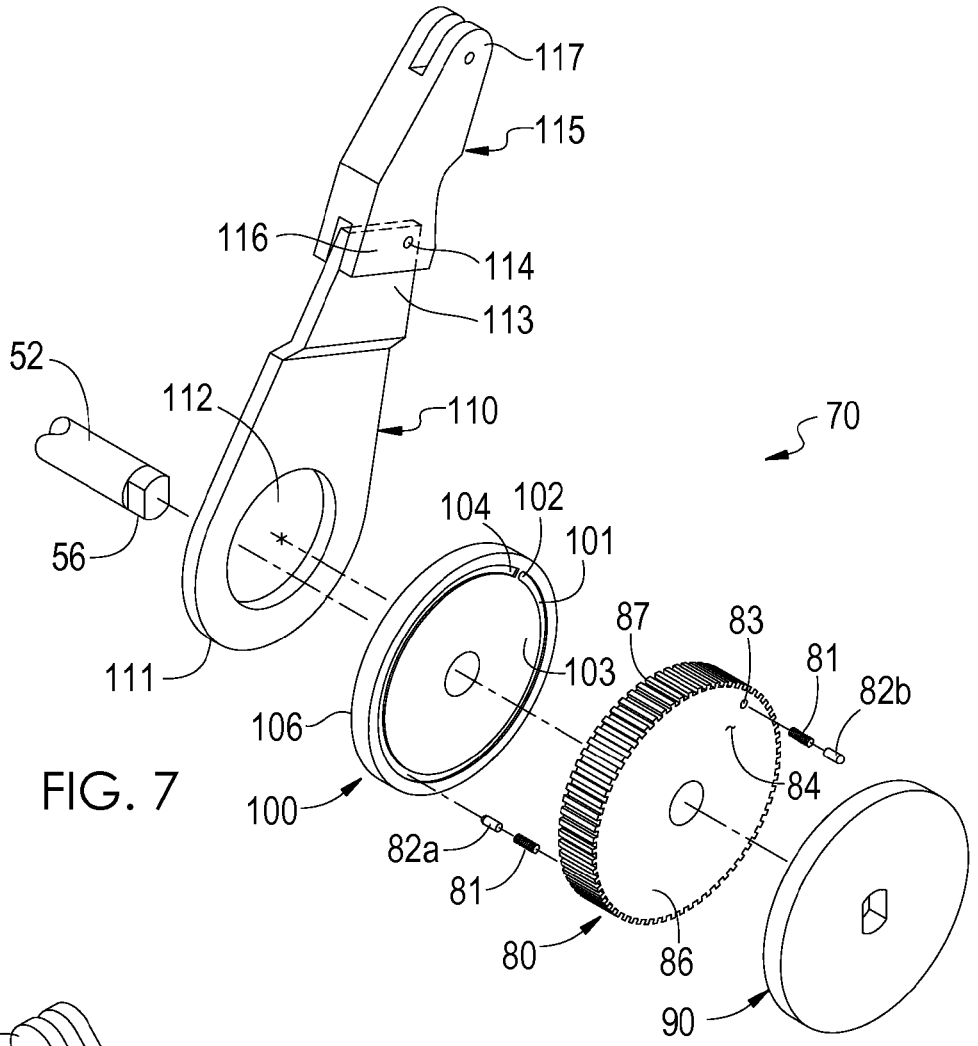
FIG. 7 is an exploded rear perspective view of the drive mechanism of the present invention.
Figure 8:
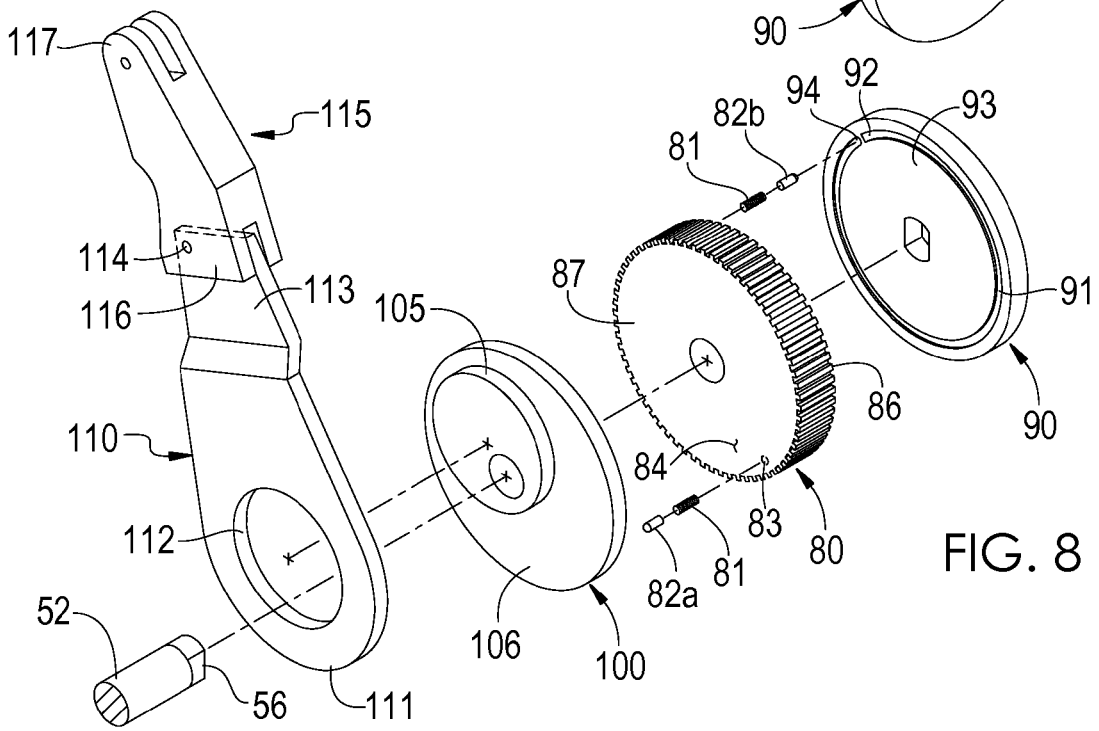
FIG. 8 is an exploded front perspective view of the drive mechanism of the present invention.
Figure 9:
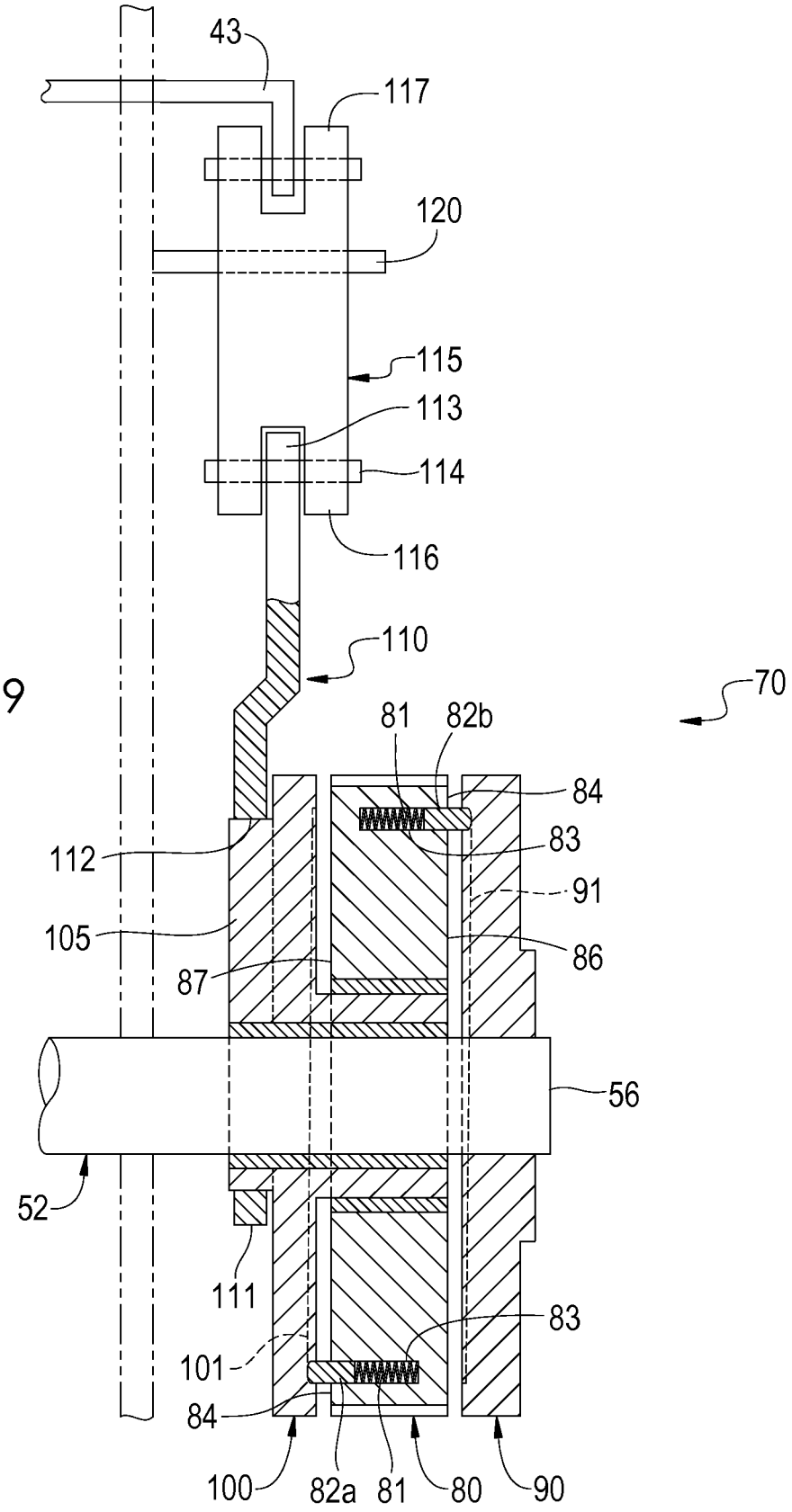
FIG. 9 is side sectional view of the drive mechanism of the present invention.

The preferred embodiment of the present invention is shown in FIGS. 2-13. In FIG. 2, the invention is schematically shown. In FIGS. 3-13, detailed views of the lint filter cleaning and lint collection apparatus 25 and its operation are shown. Referring to FIG. 2, the dryer 20 includes a rotatable drum 21, an air conduit 22, a blower motor 23, an air exhaust conduit 24, and an automatic lint filter cleaning and lint collection apparatus 25, or "lint collection apparatus". The blower motor 23 pulls heated air through the rotatable drum 21, through the air conduit 22, through the lint collection apparatus 25, and then forces the air through the air exhaust conduit 24 to the outside of the dryer. The direction of air flow is indicated by the arrows.

Referring to FIGS. 3-13, air from the drum 21 preferably flows through an air inlet 31 into a first air chamber 32, downwards through a first opening 33 into a lint collection chamber 34, upwards through a lint filter 40 into a lint filter pivot chamber 36, through a second opening 37 into a second air chamber 38, and out of the apparatus 25 through an air outlet 39. The lint filter 40 is secured within a pivotable lint filter housing 41 operable to pivot within the lint filter pivot chamber 36. A flange 42 forms a perimeter along an inner surface of the apparatus 25 between the pivot chamber 36 and the collection chamber 34, wherein the lint filter housing 41 abuts the flange 42 when the filter housing 41 is in a substantially horizontal or "home" position. The filter housing 41 includes a pivot arm 43 operably connected to a drive mechanism 70 and a spring arm 44 operably connected to a spring 46. The spring first end 47 is preferably attached to the spring arm 44 and the spring second end 48 is preferably attached to the pivot chamber 36 housing such that the filter housing 41 is biased against the flange 42. The spring 46 can be any type of spring suitable to bias the filter housing 41 against the flange 42, although a compression spring is preferred.

The bottom of the lint collection chamber 34 forms a tapering hopper 35 to collect lint 50. A rotatable auger 51 is mounted within the hopper 35 and extends through a short pipe 61 into a lint collection box 62 through a hole 63 therein. The lint collection box 62 is removably located within a collection box chamber 64. A lint collection bag 66 is preferably removably securable within the collection box 62. The collection bag 66 preferably comprises an air impermeable plastic. The collection bag 66 is secured within the collection box 62 such that the bag opening 67 aligns with the collection box hole 63. The collection box 62 is insertable within the collection box chamber 64 such that the short pipe 61 extends through the collection box hole 63 and collection bag opening 67 into the collection bag 66, thereby reversibly securing the collection bag 66 to the short pipe 61. An airtight seal is formed between the collection bag 66 and the short pipe 61. The inside surface of the short pipe 61 preferably includes a helical protrusion 68 (see FIG. 6) that enhances transfer of lint 50 from the hopper 35 through the pipe 61 and into the collection box 62, described in greater detail below.

The auger 51 comprises a shaft 52 having a helical flange 53. The shaft 52 has a proximal end 55 that extends into the collection box 62 and a distal end 56 that is secured to the drive mechanism 70. The outside diameter of the helical flange 53 (flight outside diameter) decreases from the distal end 57 of the flight length towards the proximal end 58 of the flight length such that the helical flange 53 has a distal portion outside diameter 54*a* that is greater in the hopper 35 and a proximal portion outside diameter 54*b* that is reduced in the short pipe 61 (see FIGS. 5 and 6). Further, the distance between the adjacent helical revolutions (pitch) decreases from the distal end 57 of the flight length towards the proximal end 58 of the flight length such that the pitch is greater in the hopper 35 and reduced in the short pipe 61 (see FIGS. 5 and 6). This auger design enhances transfer of lint 50 from the hopper 35 into the collection box 62. The helical protrusion 68 along the inside surface of the short pipe 61, if present, cooperates with the above described auger design to further enhance transfer of lint 50 from the hopper 35 into the collection box 62. The helix direction of the auger helical flange 53 is preferably opposite to the helix direction of the short pipe helical protrusion 68. Thus, if the auger helical flange 53 is a right-handed helix (as shown), the short pipe helical protrusion 68 is preferably a left-handed helix (as shown). The hopper 35 has a bottom end that forms an elongated channel that is slightly wider than the auger 51 and extends from the distal end 57 of the flight length to the short pipe 61 entrance. The bottom surface of the hopper 35 preferably has a distal segment 59*a* immediately subjacent the auger flight length distal end 57 and a recessed proximal segment 59*b* that slopes upward from the distal segment 59*a* to the short pipe 61 entrance, best seen in FIG. 6. The recessed proximal segment 59*b* provides space for the lint to collect and the upward slope enhances the transfer of lint 50 from the hopper 35 into the short pipe 61.

The drive mechanism 70 comprises a drive motor 71 that drives a drive shaft 72 and drive wheel 73, a drive belt 74, and a drive pulley 80. The drive pulley 80 is mounted for independent rotation about the auger shaft 52. The drive pulley 80 has a spring 81 and a pin (detent) 82*a*, 82*b* secured within a recess 83 on each side so that each detent 82*a*, 82*b* is operable to extend outward from the drive pulley surface 84. A proximal detent 82*a* is located on a proximal side 87 of the drive pulley 80 and a distal detent 82*b* is located on a distal side 86 of the drive pulley 80. An auger drive wheel 90 is preferably mounted adjacent the distal side 86 of the drive pulley 80, wherein the auger drive wheel 90 is secured to the auger shaft distal end 56 for concomitant rotation. The auger drive wheel 90 includes a sloping arcuate slot 91 that has a first end 92 that is coplanar with the surface 93 of the auger drive wheel 90 and a second end 94 that is recessed below the auger drive wheel surface 93. A filter housing drive wheel 100 is preferably mounted adjacent the proximal side 87 of the drive pulley 80, wherein the filter housing drive wheel 100 is mounted for independent rotation about the auger shaft 52. The filter housing drive wheel 100 includes a sloping arcuate slot 101 that has a first end 102 that is coplanar with the surface 103 of the filter housing drive wheel 100 and a second end 104 that is recessed below the filter housing drive wheel surface 103. The filter housing drive wheel 100 has an eccentric cam 105 formed along a proximal side 106 thereof.

The drive mechanism 70 further comprises a crank arm 110 mounted adjacent the proximal side 106 of the filter housing drive wheel 100. The crank arm 110 has a first end 111 having a hole 112 therein for receiving the eccentric cam 105 of the filter housing drive wheel 100. The crank arm 110 has a second end 113 that is pivotably connected at a pivot point 114 to a first end 116 of a lift arm 115. The lift arm 115 has a second end 117 that is pivotably connected to the pivot arm 43 of the filter housing 41. A cam bar 120 extends from the apparatus 25 housing adjacent the lift arm 115.

Figure 11:
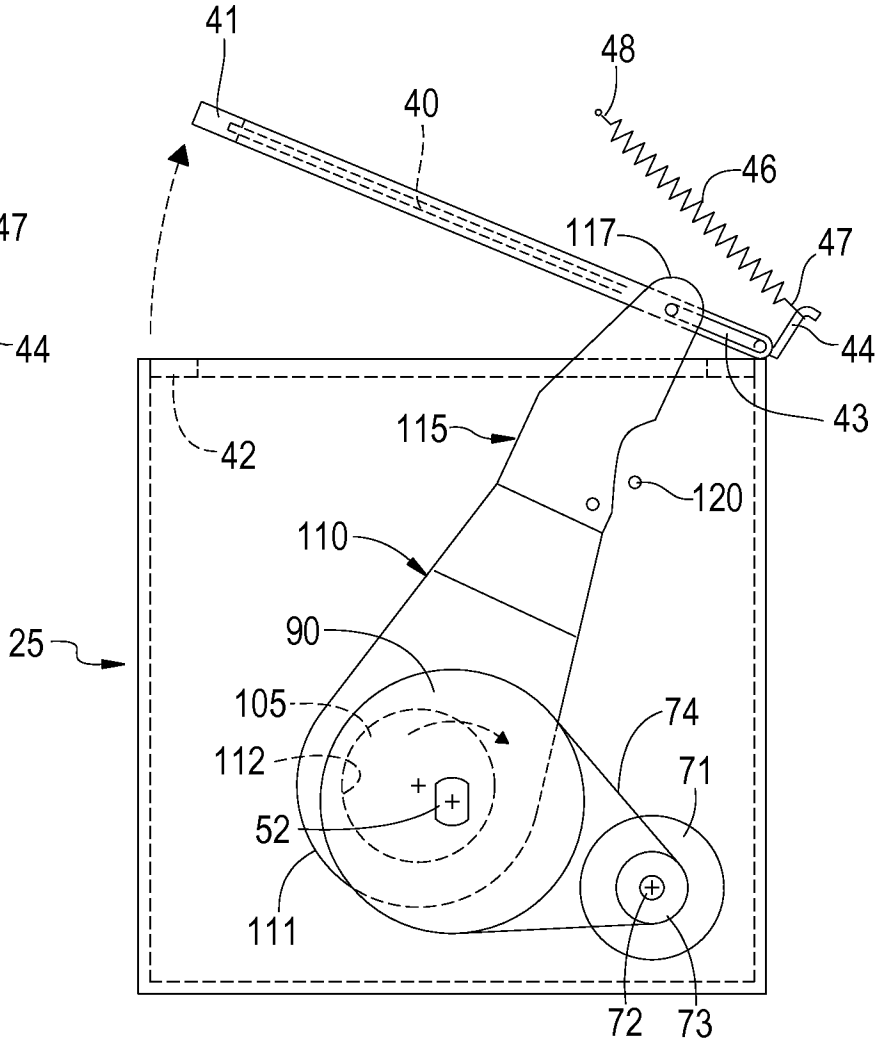
FIG. 11 shows the lint filter housing in a partially raised position.
Figure 10:
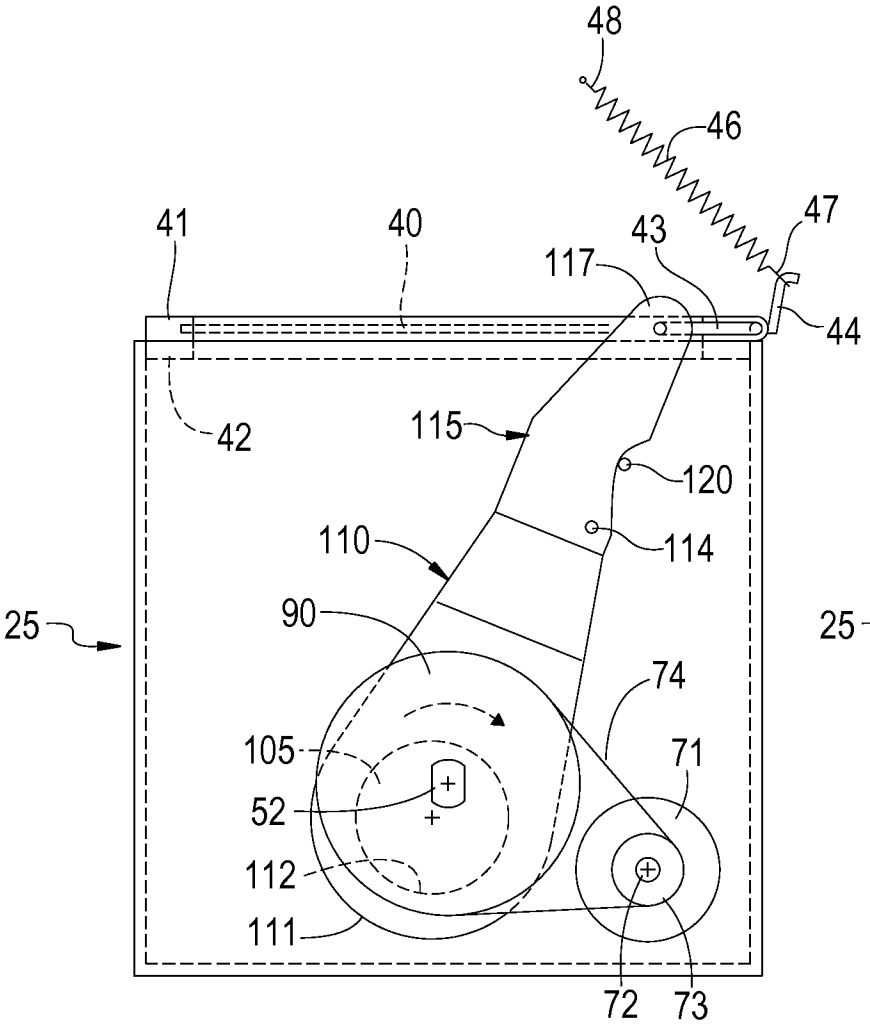
FIG. 10 shows the lint filter housing in the home position.
Figure 13:
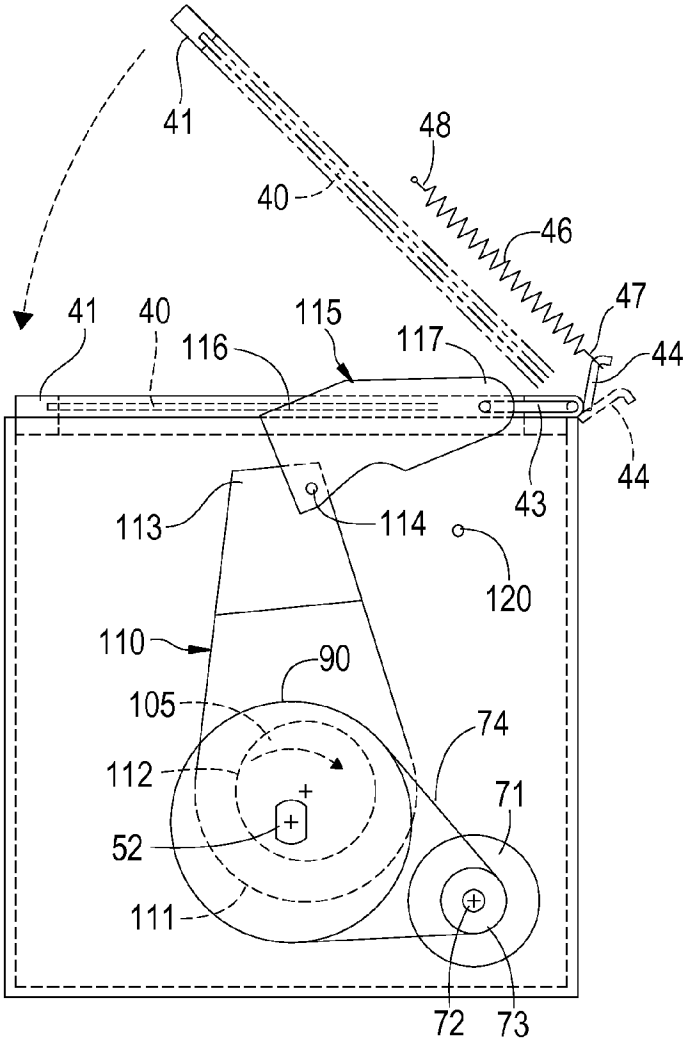
FIG. 13 shows the lint filter housing returning to the home position.
Figure 12:
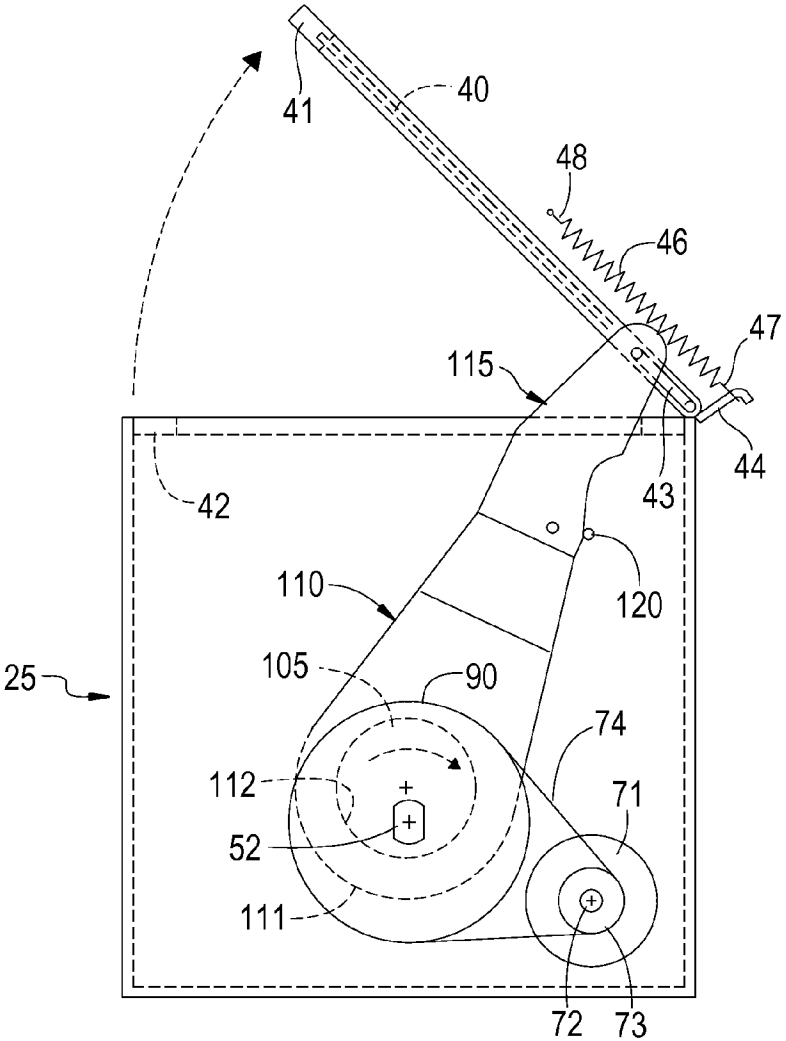
FIG. 12 shows the lint filter housing in a fully raised position.

In operation, the dryer 20 is operated through a drying cycle. The lint filter 40 and filter housing 41 are in the home position shown in FIG. 10. After a preset delay at the end of the drying cycle to allow time for air flow to cease, the dryer 20 initiates a lint filter cleaning cycle and the drive mechanism 70 is actuated to clean the lint filter 40. The drive motor 71 is actuated to rotate the drive wheel 73 in a first direction (e.g. clockwise) which causes the drive pulley 80 to rotate in a first direction (e.g. clockwise) by operation of the drive belt 74. As the drive pulley 80 rotates in the first direction, the spring-actuated proximal detent 82*a* will slide within the sloping arcuate slot 101 in the filter housing drive wheel 100 until it engages the recessed second end 104 of the arcuate slot 101, after which, the proximal detent 82*a* will force the filter housing drive wheel 100 to rotate in the first direction concurrently therewith. When the drive pulley 80 is rotating in the first direction, the distal detent 82*b* slides within the sloping arcuate slot 91 of the auger drive wheel 90 but does not engage the auger drive wheel 90 because of the direction of rotation within the arcuate slot 91. As the filter housing drive wheel 100 rotates in the first direction, the eccentric cam 105 urges the crank arm 110 angularly upwards which, in turn, urges the lift arm 115 angularly upwards, as shown in FIGS. 11 and 12. As the lift arm 115 moves upwards, it transmits lifting force to the pivot arm 43 which pivots the filter housing 41 upwards within the pivot chamber 36. The maximum angle of the filter housing 41 relative to the flange 42 is between 30 to 90 degrees, most preferably 75 degrees. As the eccentric cam 105 reaches its uppermost limit, shown in FIG. 12, the lift arm 115 engages the cam bar 120, which urges the first end 116 of the lift arm 115 and the second end 113 of the crank arm 110 to pivot about pivot point 114 relative to each other and away from cam bar 120. As this occurs, the upward lifting force of the lift arm 115 is suddenly released and the filter housing 41 rapidly falls back into abutment with the flange 42 (see FIG. 13). This "slapping" action dislodges lint adhered to the filter 40, allowing the lint to fall into the hopper 35. As the filter housing drive wheel 100 continues to rotate in the first direction, the eccentric cam 105 urges the crank arm 110 downward and the crank arm 110 and lift arm 115 pivot about pivot point 114 back into linear alignment with each other, as shown in FIG. 10. The lint filter cleaning cycle can include one or more, preferably two, of these lint filter "slapping" cycles after each drying cycle.

After the lint filter cleaning cycle is completed, the dryer 20 initiates a lint collection cycle and the drive mechanism 70 is actuated to transfer lint from the hopper 35 to the collection box 62. The drive motor 71 is actuated to rotate the drive wheel 73 in a second direction (e.g. counter-clockwise) which causes the drive pulley 80 to rotate in a second direction (e.g. counter-clockwise) by operation of the drive belt 74. As the drive pulley 80 rotates in the second direction, the spring-actuated distal detent 82*b* will slide within the sloping arcuate slot 91 in the auger drive wheel 90 until it engages the recessed second end 94 of the arcuate slot 91, after which, the distal detent 82*b* will force the auger drive wheel 90 to rotate in the second direction concurrently therewith. When the drive pulley 80 is rotating in the second direction, the proximal detent 82*a* slides within the sloping arcuate slot 101 of the filter housing drive wheel 100 but does not engage the filter housing drive wheel 100 because of the direction of rotation within the arcuate slot 101. As the auger drive wheel 90 rotates in the second direction, the auger 51 rotates therewith and the helical flange 53 advances lint 50 from the hopper 35, through the short pipe 61, and into the collection bag 66 within the collection box 62. The lint collection cycle runs for a preset period of time, preferably 20 seconds. Once the lint collection cycle is completed, the dryer 20 will turn off. In an alternate embodiment, the auger 51 may include a reciprocating knife blade (not shown) mounted within the shaft 52 and extending slightly beyond the shaft surface to cut materials, such as hair, that wrap around the shaft 52. The knife blade can be actuated to cycle back and forth after the auger 51 has ceased rotating.

The present invention cleans the lint filter 40 after each drying cycle and thus prevents lint buildup and interference with proper dryer function. Depending on the frequency of dryer use, the collection bag 66 should not need to be replaced for at least 6 months. A sensor detects when the collection bag 66 is full and activates a signal light on the dryer 20. The collection box 62 can be removed by a user through an access panel in the dryer 20, the collection bag 66 can be easily detached and removed from the collection box 62, a replacement collection bag 66 can be secured within the collection box 62, and the collection box 62 can be inserted back into the collection box chamber 64 to engage the short pipe 61. A safety feature can be included that prevents operation of the dryer 20 when the collection bag 66 is full.

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as described and claimed herein.

The invention claimed is:

1. A lint filter cleaning and lint collection apparatus for a laundry dryer, comprising:

a) an apparatus housing;

b) a lint filter pivot chamber formed in an upper portion of said apparatus housing;

c) a lint collection chamber formed in a lower portion of said apparatus housing below said pivot chamber;

d) a lint filter housing pivotably mounted within said apparatus housing between said pivot chamber and said collection chamber;

e) a lint filter secured within said filter housing;

f) a flange formed along an internal surface of said apparatus housing between said pivot chamber and said collection chamber, wherein said filter housing is biased into abutment with said flange;

g) a lint collection container;

h) a pipe connecting said collection chamber and said collection container;

i) an auger rotatably mounted within said collection chamber, said auger having a proximal end and a distal end, wherein said proximal end extends through said pipe and into said collection container; and j) a drive assembly operably connected to said filter housing and said distal end of said auger;

k) wherein said drive assembly is operable to pivot said filter housing within said pivot chamber and away from said flange, wherein said drive assembly is further operable to release said filter housing after said filter housing has been pivoted away from said flange such that said filter housing forcibly returns into abutment with said flange, wherein said lint filter is operable to release lint adhered thereto into said collection chamber when said filter housing forcibly returns into abutment with said flange;

l) wherein said drive assembly is further operable to rotate said auger and said auger is operable to move lint from said collection chamber, through said pipe, and into said collection container as said auger rotates.

2. The apparatus according to claim 1, wherein said collection chamber has a bottom end that forms an elongated channel that extends from said distal end of said auger to said pipe, wherein said auger is mounted for rotation within said elongated channel.

3. The apparatus according to claim 2, wherein said bottom end of said collection chamber has a bottom surface having a distal segment immediately subjacent said distal end of said auger and a recessed proximal segment that slopes upward from said distal segment to said pipe.

4. The apparatus according to claim 1, wherein said pipe comprises a helical protrusion along an inside surface thereof to promote transfer of lint through said pipe and into said collection container as said auger rotates.

5. The apparatus according to claim 1, wherein said auger comprises a helical flange having an outside diameter that decreases from said distal end of said auger towards said proximal end.

6. The apparatus according to claim 5, wherein said helical flange has a pitch that decreases from said distal end of said auger towards said proximal end.

7. The apparatus according to claim 1, wherein said drive assembly comprises:

a) a drive motor;

b) a filter housing drive wheel operably connected to said drive motor and said lint filter housing, wherein said drive motor is operable to rotate said filter housing drive wheel in a first rotational direction, wherein said filter housing drive wheel is operable to pivot said filter housing within said pivot chamber and away from said flange as said filter housing drive wheel rotates in said first rotational direction; and c) an auger drive wheel operably connected to said drive motor and said distal end of said auger, wherein said drive motor is operable to rotate said auger drive wheel in a second rotational direction, wherein said auger drive wheel is operable to rotate said auger as said auger drive wheel rotates in said second rotational direction, wherein said auger is operable to move lint from said collection chamber, through said pipe, and into said collection container as said auger rotates.

8. The apparatus according to claim 1, wherein said drive assembly comprises:

a) a drive motor;

b) a drive pulley operably connected to said drive motor, said drive pulley having a first side having a first spring actuated detent;

c) a lift arm operably connected to said lint filter housing;

d) a crank arm operably connected to said lift arm; and e) a filter housing drive wheel operably connected to said drive pulley and said crank arm, said filter housing drive wheel having a first side having an eccentric cam formed thereon for engaging said crank arm and a second side having a sloping arcuate slot that terminates at a recessed end;

f) wherein said drive pulley is operable to rotate in a first rotational direction, wherein said first spring actuated detent is operable to slide within said arcuate slot of said filter housing drive wheel and engage said arcuate slot recessed end of said filter housing drive wheel and thereby rotate said filter housing drive wheel in said first rotational direction as said drive pulley rotates in said first rotational direction, wherein said filter housing drive wheel is operable to lift said crank arm as said filter housing drive wheel rotates in said first rotational direction, wherein said crank arm is operable to lift said lift arm as said crank arm is lifted, wherein said lift arm is operable to pivot said filter housing within said pivot chamber and away from said flange as said lift arm is lifted.

9. The apparatus according to claim 8, wherein said drive assembly further comprises a cam bar mounted adjacent to said lift arm, wherein said crank arm is further operable to pivot said lift arm into engagement with said cam bar after said filter housing has been pivoted away from said flange, wherein said cam bar is operable to pivot said lift arm relative to said cam bar such that said filter housing is released to return into abutment with said flange.

10. The apparatus according to claim 8, wherein said drive pulley has a second side having a second spring actuated detent.

11. The apparatus according to claim 10, wherein said drive assembly further comprises an auger drive wheel operably connected to said drive pulley and said distal end of said auger, said auger drive wheel having a first side having a sloping arcuate slot that terminates at a recessed end.

12. The apparatus according to claim 11, wherein said drive pulley is further operable to rotate in a second rotational direction, wherein said second spring actuated detent is operable to slide within said arcuate slot of said auger drive wheel and engage said arcuate slot recessed end of said auger drive wheel and thereby rotate said auger drive wheel in said second rotational direction as said drive pulley rotates in said second rotational direction, wherein said auger drive wheel is operable to rotate said auger as said auger drive wheel rotates in said second rotational direction, wherein said auger is operable to move lint from said collection chamber, through said pipe, and into said collection container as said auger rotates.

13. An apparatus for collecting lint in a laundry dryer, comprising:

a) a lint collection chamber;

b) a lint collection container;

c) a pipe connecting said collection chamber and said collection container;

d) an auger rotatably mounted within said collection chamber, said auger having a proximal end and a distal end, wherein said proximal end extends through said pipe and into said collection container; and e) a drive assembly operably connected to said distal end of said auger;

f) wherein said drive assembly is operable to rotate said auger and said auger is operable to move lint from said collection chamber, through said pipe, and into said collection container as said auger rotates;

g) wherein said collection chamber has a bottom end that forms an elongated channel that extends from said distal end of said auger to said pipe, wherein said auger is mounted for rotation within said elongated channel;

h) wherein said bottom end of said collection chamber has a bottom surface having a distal segment immediately subjacent said distal end of said auger and a recessed proximal segment that slopes upward from said distal segment to said pipe.

14. An apparatus for collecting lint in a laundry dryer, comprising:

a) a lint collection chamber;

b) a lint collection container;

c) a pipe connecting said collection chamber and said collection container;

d) an auger rotatably mounted within said collection chamber, said auger having a proximal end and a distal end, wherein said proximal end extends through said pipe and into said collection container; and e) a drive assembly operably connected to said distal end of said auger;

f) wherein said drive assembly is operable to rotate said auger and said auger is operable to move lint from said collection chamber, through said pipe, and into said collection container as said auger rotates;

g) wherein said pipe comprises a helical protrusion along an inside surface thereof to promote transfer of lint through said pipe and into said collection container as said auger rotates.

15. The apparatus according to claim 14, wherein said auger comprises a helical flange having an outside diameter that decreases from said distal end of said auger towards said proximal end.

16. The apparatus according to claim 15, wherein said helical flange has a pitch that decreases from said distal end of said auger towards said proximal end.

17. An apparatus for cleaning a lint filter in a laundry dryer, comprising:

a) an apparatus housing;

b) a lint filter pivot chamber formed in an upper portion of said apparatus housing;

c) a lint collection chamber formed in a lower portion of said apparatus housing below said pivot chamber;

d) a lint filter housing pivotably mounted within said apparatus housing between said pivot chamber and said collection chamber;

e) a lint filter secured within said filter housing;

f) a flange formed along an internal surface of said apparatus housing between said pivot chamber and said collection chamber, wherein said filter housing is spring-biased into abutment with said flange;

g) a spring attached at a first end to said filter housing and at a second end to said pivot chamber, wherein said spring is operable to bias said filter housing against said flange; and h) a drive assembly operably connected to said filter housing, wherein said drive assembly comprises a drive motor operably connected to said filter housing for pivoting said filter housing within said pivot chamber away from said flange;

i) wherein said drive assembly is operable to release said filter housing after said filter housing has been pivoted away from said flange, wherein said spring is operable to forcibly return said filter housing into abutment with said flange after said drive assembly releases said filter housing, wherein said lint filter is operable to release lint adhered thereto into said collection chamber when said filter housing forcibly returns into abutment with said flange.

18. An apparatus for cleaning a lint filter in a laundry dryer, comprising:

a) an apparatus housing;

b) a lint filter pivot chamber formed in an upper portion of said apparatus housing;

c) a lint collection chamber formed in a lower portion of said apparatus housing below said pivot chamber;

d) a lint filter housing pivotably mounted within said apparatus housing between said pivot chamber and said collection chamber;

e) a lint filter secured within said filter housing;

f) a flange formed along an internal surface of said apparatus housing between said pivot chamber and said collection chamber, wherein said filter housing is biased into abutment with said flange; and g) a drive assembly operably connected to said filter housing, wherein said drive assembly is operable to pivot said filter housing within said pivot chamber and away from said flange, wherein said drive assembly is further operable to release said filter housing after said filter housing has been pivoted away from said flange such that said filter housing forcibly returns into abutment with said flange, wherein said lint filter is operable to release lint adhered thereto into said collection chamber when said filter housing forcibly returns into abutment with said flange;

h) wherein said drive assembly comprises a drive motor, a drive pulley operably connected to said drive motor wherein said drive pulley has a first side with a first spring actuated detent, a lift arm operably connected to said lint filter housing, a crank arm operably connected to said lift arm, and a filter housing drive wheel operably connected to said drive pulley and said crank arm wherein said filter housing drive wheel has a first side with an eccentric cam formed thereon for engaging said crank arm and a second side having a sloping arcuate slot that terminates at a recessed end;

i) wherein said drive pulley is operable to rotate in a first rotational direction, wherein said first spring actuated detent is operable to slide within said arcuate slot of said filter housing drive wheel and engage said arcuate slot recessed end of said filter housing drive wheel and thereby rotate said filter housing drive wheel in said first rotational direction as said drive pulley rotates in said first rotational direction, wherein said filter housing drive wheel is operable to lift said crank arm as said filter housing drive wheel rotates in said first rotational direction, wherein said crank arm is operable to lift said lift arm as said crank arm is lifted, wherein said lift arm is operable to pivot said filter housing within said pivot chamber and away from said flange as said lift arm is lifted.

19. The apparatus according to claim 18, wherein said drive assembly further comprises a cam bar mounted adjacent to said lift arm, wherein said crank arm is further operable to pivot said lift arm into engagement with said cam bar after said filter housing has been pivoted away from said flange, wherein said cam bar is operable to pivot said lift arm relative to said cam bar such that said filter housing is released to return into abutment with said flange.

* * * * *